US009176402B2

(12) United States Patent
Tada et al.

(10) Patent No.: US 9,176,402 B2
(45) Date of Patent: Nov. 3, 2015

(54) METHOD FOR MANUFACTURING TONER, TONER AND IMAGE FORMING METHOD

(75) Inventors: Keisuke Tada, Shizuoka (JP); Kenichi Uehara, Shizuoka (JP); Daisuke Misawa, Shizuoka (JP); Ayumi Oikawa, Kanagawa (JP); Hiroshi Endoh, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/344,858

(22) PCT Filed: Sep. 12, 2012

(86) PCT No.: PCT/JP2012/073968
§ 371 (c)(1),
(2), (4) Date: Mar. 13, 2014

(87) PCT Pub. No.: WO2013/039254
PCT Pub. Date: Mar. 21, 2013

(65) Prior Publication Data

US 2014/0342282 A1 Nov. 20, 2014

(30) Foreign Application Priority Data

Sep. 13, 2011 (JP) ..... 2011-199565

(51) Int. Cl.
*G03G 9/08* (2006.01)
*G03G 9/087* (2006.01)

(52) U.S. Cl.
CPC ..... *G03G 9/0804* (2013.01); *G03G 9/087* (2013.01); *G03G 9/0821* (2013.01); (Continued)

(58) Field of Classification Search
CPC ..... G03G 9/0804; G03G 9/0825
USPC ..... 430/137.1, 137.14
See application file for complete search history.

(56) References Cited

U.S. PATENT DOCUMENTS

2008/0176164 A1 7/2008 Nair et al.
2008/0182186 A1 7/2008 Usami et al.
(Continued)

FOREIGN PATENT DOCUMENTS

EP 1 950 615 A2 7/2008
EP 2 113 094 11/2009
(Continued)

OTHER PUBLICATIONS

International Search Report Issued Nov. 27, 2012 for counterpart International Patent Application No. PCT/JP2012/073968 Filed Sep. 12, 2012.
Extended European Search Report issued Jan. 27, 2015 in Patent Application No. 12832325.0.

*Primary Examiner* — Mark A Chapman
(74) *Attorney, Agent, or Firm* — Oblon, McClelland, Maier & Neustadt, L.L.P.

(57) ABSTRACT

A method for manufacturing a toner, including at least: dissolving or dispersing a toner material including at least any one of a binder resin and a precursor of a binder resin in an organic solvent which is dispersed in a dispersant-including aqueous medium; forming particles by removing the organic solvent; washing the particles; forming voids in the particles by heating to a temperature T while or after dispersing the particles in an aqueous medium; forming toner base particles by adding a charge controlling agent; and adding an external additive to the toner base particles to obtain toner particles, wherein the T is between a glass transition temperature Tg of the toner particles and Tg+25° C., and the toner has a cross-sectional void fraction Sp/St of 0.1% to 15.0%, where St is a cross-sectional area of the toner particles, and Sp is a cross-sectional area of the voids.

14 Claims, 1 Drawing Sheet

(52) U.S. Cl.
CPC ..... *G03G 9/0825* (2013.01); *G03G 9/08755* (2013.01); *G03G 9/08795* (2013.01); *G03G 9/08797* (2013.01); *G03G 2215/0626* (2013.01); *G03G 2215/16* (2013.01); *G03G 2215/20* (2013.01)

(56) References Cited

U.S. PATENT DOCUMENTS

| | | | | |
|---|---|---|---|---|
| 2011/0136052 | A1 | 6/2011 | Watanabe et al. | |
| 2013/0216944 | A1 * | 8/2013 | Shiba et al. ..... | 430/105 |

FOREIGN PATENT DOCUMENTS

| | | | |
|---|---|---|---|
| JP | 09-090675 | | 4/1997 |
| JP | 2000-275907 | | 10/2000 |
| JP | 2004-295152 | | 10/2004 |
| JP | 2006-227592 | | 8/2006 |
| JP | 2008-180924 | | 8/2008 |
| JP | 2008-257056 | | 10/2008 |
| JP | 2011-059372 | | 3/2011 |
| JP | 2011-123215 | | 6/2011 |
| WO | WO 2008/088697 | A1 | 7/2008 |

* cited by examiner

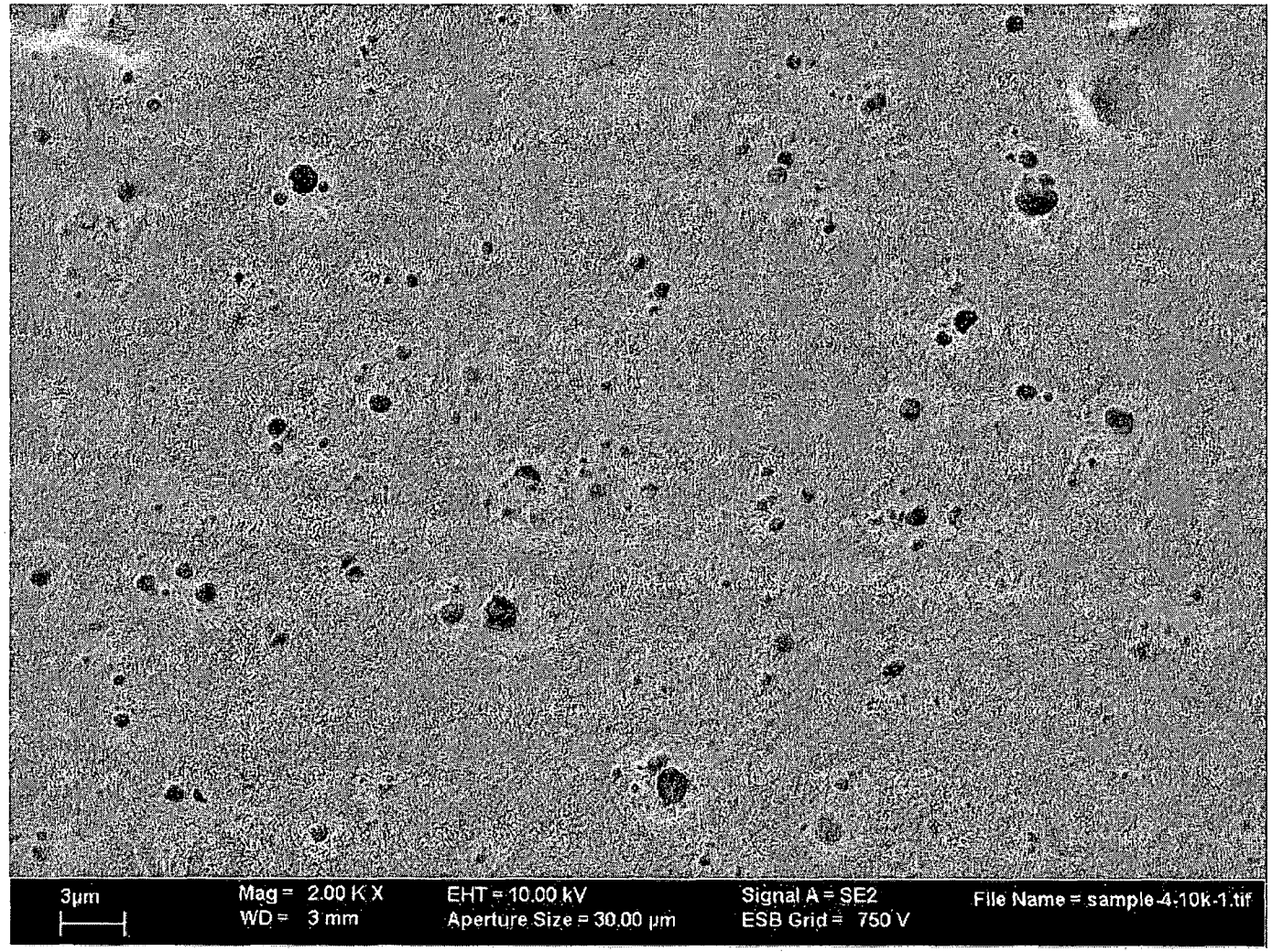
3µm
Mag = 2.00 K X
WD = 3 mm
EHT = 10.00 kV
Aperture Size = 30.00 µm
Signal A = SE2
ESB Grid = 750 V
File Name = sample-4-10k-1.tif

METHOD FOR MANUFACTURING TONER, TONER AND IMAGE FORMING METHOD

CROSS REFERENCE TO RELATED APPLICATIONS

The present application is a 35 U.S.C. §371 national stage patent application of International patent application PCT/JP2012/073968, filed on Sep. 12, 2012, published as WO/2013/039254 on Mar. 21, 2013, the text of which is incorporated by reference, and claims the benefit of the filing date of Japanese application no. 2011-199565, filed on Sep. 13, 2011, the text of which is also incorporated by reference.

TECHNICAL FIELD

The present invention relates to a toner for developing an electrostatic latent image in electrophotography, electrostatic recording and electrostatic printing, a method for manufacturing the toner, and an image forming method using the toner.

BACKGROUND ART

In an electrophotographic apparatus and an electrostatic recording apparatus, a toner is adhered to an electrostatic latent image formed on a photoconductor, which is transferred to a recording medium and fixed on the recording medium by heat, and a toner image is formed.

Also, in general, a full-color image is formed by reproducing colors using toners of four colors, namely yellow, magenta, cyan and black. A toner image that the respective toners are superimposed on a recording medium is heated and fixed, and a full-color image is formed.

Generally speaking, a toner used for developing an electrostatic image includes colored particles including a colorant, a charge controlling agent and other additives in a binder resin, and as a manufacturing method thereof, there are roughly a pulverization method and a polymerization method.

In the pulverization method, a toner composition is prepared by melt-mixing and dispersing uniformly a colorant, a charge controlling agent and an offset preventing agent in a thermoplastic resin. The toner composition is pulverized and classified, and a toner is manufactured.

According to this pulverization method, the toner may be manufactured at low cost. However, it is likely that the toner has a broad particle size distribution, and there is a disadvantage of a very low yield due to classification.

Also, in the pulverization method, it is difficult to disperse the colorant and the charge controlling agent uniformly in the thermoplastic resin. Non-uniform dispersion of the ingredients adversely affects toner fluidity, developability, durability and image quality.

In recent years, higher image quality is further desired to satisfy high resolution and high definition close to photography or printing, and as a method for manufacturing a toner having a small particle diameter and a narrow particle size distribution, toner particles of an irregular shape are obtained by associating resin particles by an emulsion polymerization method.

Reduction of a particle size of the toner largely accounts for improved number of image output per unit mass of toner due to reduced amount of toner adhesion on paper, etc. per unit area (low M/A).

As a means to reduce an adhesion amount of a toner, a technique to create voids inside toner particles has been tried.

A method to achieve a reduced adhesion amount of a toner (low M/A) while maintaining the toner to a minimal particle size to ensure developability, transferability and fixability is disclosed (see PTL 1). However, it does not describe details of a method to control an amount of the voids.

A method to control internal voids of a toner by controlling a solvent volatilization rate in the inside of particles is disclosed (see PTL 2). However, the voids formed by the solvent volatilization are not only spherical but also crack-shaped. When the particles have a large void fraction, the particles collapse due to lack of mechanical strength, which causes problems such as carrier spent.

In a method for manufacturing a polymerization toner, it is also important to achieve high production rate with high efficiency as well as quality. It is required to improve the number of image output per unit mass of toner by controlling the void fraction inside the toner particles to maintain the mechanical strength but without degrading the particle size distribution by addition of additives.

CITATION LIST

Patent Literature

PTL1 Japanese Patent Application Laid-Open (JP-A) 2000-275907

PTL2 JP-A 2008-180924

SUMMARY OF INVENTION

Technical Problem

The present invention aims at solving the above problems in the conventional technologies and at achieving the following objection. That is, the present invention is aimed at providing: a toner for developing an electrostatic latent image which brings sufficient image density, enables a reduced amount of toner adhesion per unit area of a recording medium such as paper and suppresses occurrence of carrier spent; a method for manufacturing the toner for developing an electrostatic latent image; and an image forming method.

Solution to Problem

The means for solving the above problems are as follows. That is:

A method for manufacturing a toner of the present invention includes at least:

(a) dissolving or dispersing a toner material including at least any one of a binder resin and a precursor of a binder resin in an organic solvent;

(b) dispersing a solution obtained in the (a) in a first aqueous medium including a dispersant;

(c) forming particles by removing the organic solvent from a solution obtained in the (b);

(d) washing the particles obtained in the (c);

(e) forming voids in particles obtained in the (d) by heating the particles to a temperature T while or after dispersing the particles in a second aqueous medium;

(f) forming toner base particles by adding a charge controlling agent to a solution obtained in the (e); and (g) adding an external additive to the toner base particles to obtain toner particles, wherein the temperature T in the (e) is between a glass transition temperature Tg of the toner particles and Tg+25° C., and wherein the toner has a cross-sectional void fraction Sp/St of 0.1% to 15.0%, where St is a cross-sectional area of the toner particles, and Sp is a cross-sectional area of the voids.

With a toner of the present invention manufactured by the method for manufacturing a toner, a sufficient image density is achieved, an amount of toner adhesion per unit area of a recording medium such as paper may be reduced, and occurrence of carrier spent may be suppressed.

Also, an image forming method which uses the toner obtained in the present invention includes at least: forming an electrostatic latent image; developing; transferring; and fixing. In the image forming method, an electrostatic latent image is formed on an electrostatic latent image bearing member in the forming an electrostatic latent image. In the developing, the electrostatic latent image is developed using the toner of the present invention to form a visible image. In the transferring, the visible image is transferred to a recording medium. In the fixing, the transferred image transferred on the recording medium is fixed. As a result, a sufficient image density is achieved, an amount of toner adhesion per unit area of a recording medium such as paper may be reduced, occurrence of carrier spent may be suppressed, and accordingly, a high-quality electrophotographic image may be formed.

Advantageous Effects of Invention

According to the present invention, a toner for developing an electrostatic image which may resolve the above problems in the conventional technologies, achieve the object, provide sufficient image density, enable a reduced amount of toner adhesion per unit area of a recording medium such as paper and suppress occurrence of carrier spent, a method for manufacturing the toner for developing an electrostatic image and an image forming method may be provided.

BRIEF DESCRIPTION OF DRAWINGS

FIG. 1 is an FE-SEM picture of a cross-sectional area of a toner, which indicates a status of internal voids of a toner obtained in Example 1.

DESCRIPTION OF EMBODIMENTS

Next, an embodiment to carry out the present invention is explained.

(Method for Manufacturing Toner)

A method for manufacturing a toner of the present invention includes at least: (a) dissolving or dispersing a toner material including at least any one of a binder resin and a precursor of a binder resin in an organic solvent; (b) dispersing a solution obtained in the (a) (hereinafter referred to as a first solution) in a first aqueous medium including a dispersant; (c) forming particles by removing the organic solvent from the solution obtained in the (b) (hereinafter referred to as a second solution); (d) washing the particles obtained in the (c); (e) forming voids in the particles by heating the particles to a temperature T while or after dispersing the particles obtained in the (d) in a second aqueous medium; (f) forming toner base particles by adding a charge controlling agent to a solution obtained in the (e) (hereinafter referred to as a third solution); and (g) adding an external additive to the toner base particles to obtain toner particles, wherein the temperature T in the (e) is between a glass transition temperature Tg of the toner particles and Tg+25° C., and it further includes other steps according to necessity.

Here, the toner has a cross-sectional void fraction Sp/St of 0.1% to 15.0%, where St is a cross-sectional area of the toner particles, and Sp is a cross-sectional area of the voids.

The heating in the (e) creates voids in the washed particles, which results in the toner having the cross-sectional void fraction Sp/St of 0.1% to 15.0%, preferably 3.0% to 8.0%. The voids are not created when the heating temperature T is less than Tg. The voids in the toner become large as the heating temperature T increases.

—Cross-Sectional Void Fraction of Toner—

Generally speaking, a void fraction is a quantity to characterize a porous material. It is represented by a ratio, Vp/Vt, of a volume occupied by pores Vp in a total volume Vt of a given substance, and it is obtained by measuring a specific gravity of the substance including the pores (apparent specific gravity) and a specific gravity thereof excluding the pores (true specific gravity). However, an apparent specific gravity of a powder having non-uniform surface morphology such as toner is affected dominantly by a surface shape state of the particles, and it is difficult to calculate the voids based on the apparent specific gravity.

Thus, in the present invention, an area ratio (%) of the voids at a cross-sectional area of the toner, i.e. Sp/St, where St is a cross-sectional area of the toner particles, and Sp is a cross-sectional area of the voids, is regarded as a cross-sectional void fraction (%) of the toner and is used for evaluation.

Specifically, a toner to be measured is fixed and held on a support after it is embedded in a resin, and a surface of the resin embedded with the toner is subjected to a smoothing process by an ultramicrotome (RM2265, manufactured by Leica Incorporated). Then, a picture of the surface of the resin on the support is taken using a scanning electron microscope (ULTRA55, manufactured by Carl Zeiss). Three or more average views are measured and evaluated for size and distribution of particles and voids using an image analysis software (LUZEX AP, Nireco Co., Ltd.). Using a sum of cross-sectional area of all the toner particles in one view with the cross-sectional area of the toner particles as St and a sum of cross-sectional area of the voids of all the toner particles in the view with the cross-sectional area of the voids of the toner particles as Sp, a cross-sectional void fraction Sp/St is calculated as an area ratio (%) of the voids with respect to the toner area. It is preferable to analyze nearly 100 or more particles per sample. The technique to observe an ultra-thin section cut by an ultramicrotome using a scanning microscope is preferable in terms of less damage to the sample compared to a conventional technique to observe an ultra-thin section cut by a microtome using a transmission electron microscopy (TEM). In particular, it has been known that accurate observation and evaluation of original states inside toner particles are difficult for a low-viscoelastic toner having low-temperature fixing property or a toner including voids because these toners are deformed or have their voids crushed when they are processed for ultra-thin sections using a microtome.

The cross-sectional void fraction of the toner is preferably 0.1% to 15.0%, and more preferably 3.0% to 8.0%. When the cross-sectional void fraction is less than 0.1%, reduction of the toner mass per unit apparent volume of the toner particles, which is an effect of the voids, is less effective. This is not preferable because increase in the number of image output per unit mass of toner cannot be achieved. On the other hand, when the cross-sectional void fraction exceeds 15.0%, particle formation becomes difficult, and at the same time, the toner shape cannot be maintained due to degradation of the mechanical strength of the toner. This is not preferable because the particles collapse due to development stresses, causing carrier spent. Also, downsizing of toner bottles and toner cartridges are currently underway, and a container volume is designed from the bulk density of the toner so as to be filled without gaps. When the cross-sectional void fraction exceeds 15.0%, productivity may decrease due to extended time for filling, and supply failure of the toner may occur due to blocking phenomenon of the developer caused by increased filling pressure.

When the second solution, in which particles have been generated after removing the organic solvent, is heated without washing the particles (i.e. without performing the (d)), the surfactant is not removed. The resin surface is thus stable, and the particles do not undergo shape change. Thus, voids are not created in the toner. Also, when the third solution, in which the toner base particles have been generated by adding the charge controlling agent, is heated, the charge controlling agent adhered to a surface of the toner base particles seeps out. Thus, chargeability of the toner and the toner base particles decreases.

<Step (a)>

The (a) is a step for dissolving or dispersing a toner material including at least any one of a binder resin and a precursor of a binder resin in an organic solvent. A solution obtained in the (a) is referred to as a "first solution".

Hereinafter, the (a) is explained.

—Toner Material—

The toner material includes at least any one of a binder resin and a precursor of a binder resin, and it further includes other components such as colorant and releasing agent.

—Binder Resin—

The binder resin is not particularly restricted and may be appropriately selected according to purpose. Examples thereof include: a polyester; a styrene homopolymer such as polystyrene, poly-p-chlorostyrene and polyvinyl toluene; a styrene copolymer such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chioromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer and styrene-maleic acid ester copolymer; a methacrylic acid homopolymer such as polymethylmethacrylate and polybutylmethacrylate; a vinyl homopolymer such as polyvinyl chloride, polyvinyl acetate, polyethylene and polypropylene; an epoxy resin; an epoxy-polyol resin; polyurethane; polyamide; polyvinyl butyral; polyacrylic acid; a rosin; a modified rosin; a terpene resin; an aliphatic or alicyclic hydrocarbon resin; and an aromatic petroleum resin. These may be used alone or in combination of two or more. Among these, polyester is preferable since it has favorable spreadability, and high image density may be obtained.

The polyester may be obtained by heating a polyalcohol and a polycarboxylic acid to 150° C. to 280° C. in the presence of a catalyst such as tetrabutoxy titanate and dibutyl tin oxide and by distilling generated water under a reduced pressure, if necessary, for condensation polymerization.

The polyalcohol is not particularly restricted and may be appropriately selected according to purpose. Examples thereof include: a dihydric alcohol such as ethylene glycol, diethylene glycol, triethylene glycol, propylene glycol, 1,4-bis(hydroxymethyl)cyclohexane and bisphenol A; and a tri- or more hydric alcohol having three or more hydroxyl groups. These may be used alone or in combination of two or more.

The polycarboxylic acid is not particularly restricted and may be appropriately selected according to purpose. Examples thereof include: a dicarboxylic acid such as maleic acid, fumaric acid, phthalic acid, isophthalic acid, terephthalic acid, succinic acid and malonic acid; a polycarboxylic acid having three or more carboxylic group such as 1,2,4-benzene tricarboxylic acid, 1,2,5-benzene tricarboxylic acid, 1,2,4-cyclohexane tricarboxylic acid, 1,2,4-naphthalene tricarboxylic acid, 1,2,5-hexane tricarboxylic acid, 1,3-dicarboxylic-2-methylene carboxylpropane and 1,2,7,8-octane tetracarboxylic acid. These may be used alone or in combination of two or more.

The binder resin preferably has an acid value of 2 KOHmg/g to 30 KOHmg/g. When the acid value of the binder resin is less than 2 KOHmg/g, an adhesion of the toner to paper may decrease. When it exceeds 30 KOHmg/g, the toner may have a broad particle size distribution.

The acid value may be measured according to JIS K0070-1992.

—Precursor of Binder Resin—

The precursor of a binder resin is not particularly restricted and may be appropriately selected according to purpose. Examples thereof include: a styrene monomer such as styrene, α-methylstyrene, p-methylstyrene and p-chlorostyrene; a nitrile monomer such as acrylonitrile; a (meth)acrylic acid monomer such as methyl (meth)acrylate, ethyl (meth)acrylate, butyl (meth)acrylate, ethylhexyl(meth)acrylate, lauryl (meth)acrylate and stearyl(meth)acrylic acid; and a conjugated diene monomer such as butadiene and isoprene. These may be used alone or in combination of two or more. Among these, a prepolymer having a functional group reactive with an active hydrogen group is preferable.

The prepolymer having a functional group reactive with an active hydrogen group may be reacted with a compound having an active hydrogen group when the organic solvent is removed from the second solution.

The compound having an active hydrogen group may be added when the first solution is prepared; it may be added to the first aqueous medium; or it may be added when the first solution is dispersed in the first aqueous medium. Also, the compound having an active hydrogen group may be added after the first solution is dispersed in the first aqueous medium.

The active hydrogen group is not particularly restricted and may be appropriately selected according to purpose. Examples thereof include a hydroxyl group (alcoholic hydroxyl group or a phenolic hydroxyl group), an amino group, a carboxyl group and a mercapto group. These may be used alone or in combination of two or more. Among these, an amino group is preferable since a urea-modified polyester is obtained by reacting it with a polyester prepolymer having an isocyanate group.

The prepolymer having a functional group reactive with an active hydrogen group is not particularly restricted and may be appropriately selected according to purpose. Examples thereof include polyester, a polyol resin, an acrylic resin and an epoxy resin having an isocyanate group, an epoxy group, a carboxyl group or a chlorocarbonyl group. These may be used alone or in combination of two or more.

Among these, a polyester prepolymer having an isocyanate group is preferable since a urea-modified polyester is obtained by reacting it with a compound having an amino group.

The polyester prepolymer having an isocyanate group may be obtained by reacting polyester having a hydroxyl group and polyisocyanate at 40° C. to 140° C. with an organic solvent added according to necessity.

The organic solvent is not particularly restricted and may be appropriately selected according to purpose as long as it is inert to polyisocyanate. Examples thereof include: an aromatic solvent such as toluene and xylene; a ketone solvent such as acetone, methyl ethyl ketone and methyl isobutyl ketone; an ester solvent such as ethyl acetate; an amide solvent such as dimethyl formamide and dimethyl acetamide; an ether solvent such as tetrahydrofuran. These may be used alone or in combination of two or more.

Also, the polyester having a hydroxyl group may be obtained, in the same manner as described above, by subjecting a polyalcohol and a polycarboxylic acid to condensation polymerization.

The polyalcohol is not particularly restricted and may be appropriately selected according to purpose. Examples there of include a dihydric alcohol, a tri- or more hydric alcohol, and a mixture of a dihydric alcohol and a tri- or more hydric alcohol. These may be used alone or in combination of two ore more. Among these, a mixture of a dihydric alcohol and a tri- or more hydric alcohol is preferable.

The dihydric alcohol is not particularly restricted and may be appropriately selected according to purpose. Examples thereof include: an alkylene glycol such as ethylene glycol, 1,2-propylene glycol, 1,3-propylene glycol, 1,4-butanediol and 1,6-hexanediol; a polyalkylene glycol such as diethylene glycol, triethylene glycol, dipropylene glycol, polyethylene glycol, polypropylene glycol and polybutylene glycol; an alicyclic dialcohol such as 1,4-cyclohexane dimethanol and hydrogenated bisphenol A; an alkylene oxide adduct of an alicyclic dihydric alcohol that an alkylene oxide such as ethylene oxide, propylene oxide and butylene oxide is added to an alicyclic dihydric alcohol; a bisphenol such as bisphenol A, bisphenol F and bisphenol S; and an alkylene oxide adduct of a bisphenol that an alkylene oxide such as ethylene oxide, propylene oxide and butylene oxide is added to a bisphenol. Among these, an alkylene glycol having 2 to 12 carbon atoms and an alkylene oxide adduct of a bisphenol are preferable, and an alkylene oxide adduct of a bisphenol and a mixture of alkylene oxide adduct of a bisphenol and an alkylene glycol having 2 to 12 carbon atoms are particularly preferable.

The tri- or more hydric alcohol is not particularly restricted and may be appropriately selected according to purpose. Examples thereof include: a polyhydric aliphatic alcohol having three or more hydroxyl groups such as glycerin, trimethylol ethane, trimethylol propane, pentaerythritol and sorbitol; a polyphenol having three or more hydroxyl groups such as trisphenol body (e.g. TRISPHENOL PA, manufactured by Honshu Chemical Industry Co., Ltd.), phenol novolak and cresol novolak; and an alkyleneoxide adduct of a polyphenol having three or more hydroxyl groups that an alkylene oxide such as ethylene oxide, propylene oxide and butylene oxide is added to a polyphenol having three or more hydroxyl groups.

The polycarboxylic acid is not particularly restricted and may be appropriately selected according to purpose. Examples thereof include a dicarboxylic acid, a tri- or more carboxylic acid and a mixture of dicarboxylic acid and a tri- or more carboxylic acid. These may be used alone or in combination of two or more. Among these, a mixture of dicarboxylic acid and a tri- or more carboxylic acid is preferable.

The dicarboxylic acid is not particularly restricted and may be appropriately selected according to purpose. Examples thereof include: alkylene dicarboxylic acid such as succinic acid, adipic acid and sebacic acid; and aromatic dicarboxylic acid such as phthalic acid, isophthalic acid, terephthalic acid and naphthalene dicarboxylic acid. Among these, an alkenylene dicarboxylic acid having 4 to 20 carbon atoms and an aromatic dicarboxylic acid having 8 to 20 carbon atoms are preferable.

The tri- or more carboxylic acid is not particularly restricted and may be appropriately selected according to purpose. Examples thereof include an aromatic tri- or more carboxylic acid such as trimellitic acid and pyromellitic acid. Among these, an aromatic tri- or more carboxylic acid having 9 to 20 carbon atoms is preferable.

Instead of a polycarboxylic acid, an anhydride or a lower alkyl ester of a polycarboxylic acid may also be used. The lower alkyl ester is not particularly restricted and may be appropriately selected according to purpose. Examples thereof include a methyl ester, an ethyl ester and an isopropyl ester.

When the polyester having a hydroxyl group is synthesized, an equivalent ratio of the hydroxyl group of the polyalcohol to the carboxyl group of the polycarboxylic acid is preferably 1 to 2, and more preferably 1 to 1.5 and particularly preferably 1.02 to 1.3.

The polyisocyanate having an isocyanate group is not particularly restricted and may be appropriately selected according to purpose. Examples thereof include: an aliphatic polyisocyanate such as tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate and tetramethylhexane diisocyanate; an alicyclic polyisocyanate such as isophorone diisocyanate and cyclohexylmethane diisocyanate; an aromatic diisocyanates such as tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate and diphenyl ether-4,4'-diisocyanate; an aromatic aliphatic diisocyanate such as $\alpha,\alpha,\alpha',\alpha'$-tetramethylxylylene diisocyanate; an isocyanurate such as tris(isocyanatoalkyl) isocyanurate and triisocyanatocycloalkyl isocyanurate. These may be used alone or in combination of two or more.

Instead of the polyisocyanates, a polyisocyanate with its isocyanate group blocked with a phenol derivative, an oxime or a caprolactam may also be used.

When the polyester prepolymer having an isocyanate group is synthesized, an equivalent ratio of the isocyanate group of the polyisocyanate to the hydroxyl group of the polyester having a hydroxyl group is preferably 1 to 5, more preferably 1.2 to 4, and particularly preferably 1.5 to 2.5.

A content of the constitutional unit derived from the polyisocyanate in the polyester prepolymer having an isocyanate group is preferably 0.5% by mass to 40% by mass, more preferably 1% by mass to 30% by mass, and particularly preferably 2% by mass to 20% by mass.

The compound having an amino group is not particularly restricted and may be appropriately selected according to purpose. Examples thereof include a diamine, a tri- or higher polyamine, an amino alcohol, an amino mercaptan and an amino acid. These may be used alone or in combination of two or more. Among these, a diamine and a mixture of a diamine and a small amount of a tri- or higher amine are preferable.

Examples of the diamine include: aromatic diamines such as phenylene diamine, diethyltoluene diamine and 4,4'-diaminodiphenylmethane; alicyclic diamines such as 4,4'-diamino-3,3'-dimethyldicyclohexylmethane, diaminecyclohexane and isophoron diamine; and aliphatic diamines such as ethylene diamine, tetramethylene diamine and hexamethylene diamine.

Examples of the tri- or higher amine include diethylene triamine and triethylenete tramine.

Examples of the aminoalcohol include ethanolamine and hydroxyethylaniline.

Examples of the amino mercaptan include aminoethyl mercaptan and aminopropyl mercaptan.

Examples of the amino acid include aminopropionic acid and aminocaproic acid.

Instead of the compound having an amino group, a ketimine or an oxazolidine obtained by blocking an amino group of a compound having the amino group may be used.

When the polyester prepolymer having an isocyanate group and the compound having an amino group are reacted, an equivalent ratio of the isocyanate group of the polyester prepolymer to the amino group of the compound having an amino group is preferably 0.5 to 2, more preferably is ⅔ to 1.5 and particularly preferably ⅚ to 1.2.

When the polyester prepolymer having an isocyanate group and the compound having an amino group are reacted, a catalyst such as dibutyl tin laurate and dioctyl tin laurate may be used.

A reaction temperature of the polyester prepolymer having an isocyanate group and the compound having an amino group is usually 0° C. to 150° C., and preferably 40° C. to 98° C.

A reaction time of the polyester prepolymer having an isocyanate group and the compound having an amino group is usually 10 minutes to 40 hours, and preferably 2 hours to 24 hours.

To terminate the reaction of the polyester prepolymer having an isocyanate group and the compound having an amino group, it is preferable to use a reaction terminating agent. With this, it is possible to control a molecular weight of the urea-modified polyester.

The reaction terminating agent is not particularly restricted and may be appropriately selected according to purpose. Examples thereof include: a monoamine such as diethylamine, dibutylamine, butylamine and lauryl amine; and a ketimine and an oxazoline in which an amino group of these compounds is blocked.

The toner material may include a urea-modified polyester as a binder resin. The urea-modified polyester may be obtained by reacting a polyester prepolymer having an isocyanate group and a compound having an amino group at 0° C. to 140° C. with an addition of an organic solvent according to necessity.

The organic solvent is not particularly restricted and may be appropriately selected according to purpose as long as it is inert to an isocyanate group. Examples thereof include: an aromatic compound such as toluene and xylene; a ketone such as acetone, methyl ethyl ketone and methyl isobutyl ketone; an ester such as ethyl acetate; an amide such as dimethyl formamide and dimethyl acetamide; and an ether such as tetrahydrofuran. These may be used alone or in combination of two or more.

—Other Components—

The toner material may further include other components such as colorant and releasing agent.

—Colorant—

The colorant (pigment or dye) is not particularly restricted and may be appropriately selected according to purpose. Examples thereof include: carbon black, nigrosine dye, iron black, naphthol yellow S, Hansa Yellow (10G, 5G, G), cadmium yellow, yellow iron oxide, yellow ocher, chrome yellow, titanium yellow, polyazo yellow, Oil Yellow, Hansa Yellow (GR, A, RN, R), Pigment Yellow L, Benzidine Yellow (G, GR), Permanent Yellow (NCG), Vulcan Fast Yellow (5G, R), tartrazine lake, quinoline yellow lake, Anthrazane Yellow BGL, isoindolinone yellow, colcothar, red lead, lead vermilion, cadmium red, cadmium mercury red, antimony vermilion, Permanent Red 4R, Para Red, fiser red, para-chloro-ortho-nitro aniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubin B, Brilliant Scarlet G, Lithol Rubin GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide and lithopone. These may be used alone or in combination of two or more.

A content of the colorant in the toner material is usually 1% by mass to 15% by mass, and preferably 3% by mass to 10% by mass. When the content of the colorant is less than 1% by mass, coloring strength of the toner may degrade. When it exceeds 15% by mass, the colorant the colorant may be poorly dispersed in the toner particles, which may result in degraded coloring strength or electrical characteristics of the toner.

The colorant may be combined with a resin to form a masterbatch.

The resin is not particularly restricted and may be appropriately selected according to purpose. Examples thereof include: a polyester; a styrene homopolymer such as polystyrene, poly-p-chlorostyrene and polyvinyltoluene; a styrene copolymer such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer and styrene-maleic acid ester copolymer; a methacrylic acid homopolymer such as polymethyl methacrylate and polybutyl methacrylate; a vinyl homopolymer such as polyvinyl chloride, polyvinyl acetate, polyethylene and polypropylene; an epoxy resin; an epoxy polyol resin; polyurethane; polyamide; polyvinyl butyral; polyacrylic acid; a rosin; a modified rosin; a terpene resin; an aliphatic or alicyclic hydrocarbon resin; an aromatic petroleum resin; a chlorinated paraffin; and a paraffin wax. These may be used alone or in combination of two or more.

The masterbatch may be obtained by kneading the colorant and the resin with application of high shear force. In kneading, an organic solvent is preferably added in order to enhance an interaction between the colorant and the resin. Also, a wet cake of the colorant may be directly used, and there is no need to dry. Thus, it is preferable to produce the masterbatch by a flushing method. The flushing method is to knead an aqueous paste of a colorant with a resin and an organic solvent to migrate the colorant to the resin and then to remove the water and the organic solvent. In kneading, a high-shear dispersing apparatus such as three-roll mill is preferably used.

—Releasing Agent—

The releasing agent is not particularly restricted and may be appropriately selected according to purpose. Examples thereof include: a polyolefin wax such as polyethylene wax and polypropylene wax; a long-chain hydrocarbon such as paraffin wax and sasol wax; and a wax having a carbonyl group. These may be used alone or in combination of two or more. Among these, the wax having a carbonyl group is preferable.

Examples of the wax having a carbonyl group include carnauba wax, montan wax, trimethylolpropane tribehenate, pentaerythritol tetrabehenate, pentaerythritoldiacetate dibehenate, glycerin tribehenate and 1,18-octadecanediol distearate, tristearyl trimellitate and distearyl maleate, ethylenediamine dibehenyl amide, trimellitic acid tristearyl amide and distearyl ketone.

The releasing agent has a melting point of usually 40° C. to 160° C., preferably 50° C. to 120° C., and more preferably 60° C. to 90° C. When the melting point of the releasing agent is less than 40° C., heat-resistant storage stability of the toner may degrade. When it exceeds 160° C., cold-offset may occur when the toner is fixed at a low temperature.

Also, the releasing agent has a melt viscosity at a temperature higher by 20° C. than its melting point is preferably 5 cps to 1,000 cps, and more preferably 10 cps to 100 cps. When the melt viscosity at a temperature higher by 20° C. than its melting point exceeds 1,000 cps, an effect to improve hot-offset resistance and low-temperature fixing property of the toner may be insufficient.

An amount of the releasing agent in the toner material is usually 0% by mass to 40% by mass, and preferably 3% by mass to 30% by mass.

—Organic Solvent—

The organic solvent used in the (a) is not particularly restricted as long as it may dissolve the binder resin and/or the precursor of a binder resin. Examples thereof include: an aromatic solvent such as toluene and xylene; a ketone solvent such as acetone, methyl ethyl ketone and methyl isobutyl ketone; an ester solvent such as ethyl acetate; an amide solvent such as dimethyl formamide and dimethyl acetamide; and an ether solvent such as tetrahydrofuran. These may be used alone or in combination of two or more.

When the toner material includes the precursor of a binder resin, it is necessary that the organic solvent is inert to the precursor of a binder resin.

<Step (b)>

The (b) is a step for dispersing the solution obtained in the (a) (the first solution) in a first aqueous medium including a dispersant. A solution obtained in the (b) is referred to as a "second solution".

Hereinafter, the (b) is explained.

In preparing the second solution, a method for dispersing the first solution in the first aqueous medium including a dispersant is not particularly restricted and may be appropriately selected according to purpose. Examples thereof include a method to disperse by mechanical shearing force. In this case, a toner material other than at least any one of the binder resin and the prepolymer of a binder resin may be mixed when the first solution is dispersed in the first aqueous medium, but it is preferable to mix it when the first solution is prepared.

—First Aqueous Medium—

The first aqueous medium is not particularly restricted as long as it is an aqueous medium including at least a dispersant, and it may be appropriately selected according to purpose.

The aqueous medium includes water, but it may further include an organic solvent which is miscible with water.

The organic solvent which is miscible with water includes: an alcohol such as methanol, isopropyl alcohol and ethylene glycol; dimethylformamide; tetrahydrofuran; a cellosolve such as methyl cellosolve; and a lower ketone such as acetone and methyl ethyl ketone. These may be used alone or in combination of two or more.

—Dispersant—

The dispersant is not particularly restricted and may be appropriately selected according to purpose. Examples thereof include: an anionic surfactant such as alkylbenzene sulfonate, α-olefin sulfonate and phosphate ester; an amine salt cationic surfactant such as alkylamine salt, aminoalcohol fatty acid derivative, polyamine fatty acid derivative and imidazoline; a quaternary ammonium salt cationic surfactant such as alkyltrimethyl ammonium salt, dialkyldimethyl ammonium salt, alkyldimethylbenzyl ammonium salt, pyridinium salt, alkylisoquinolinium salt and benzethonium chloride; a nonionic surfactant such as fatty acid amide derivative and polyalcohol derivative; and an amphoteric surfactant such as alanine, dodecylbis(aminoethyl)glycine, di(octylamioethyl)glycine and N-alkyl-N,N-dimethyl ammonium betaine.

Also, when a surfactant having a fluoroalkyl group such as anionic surfactant having a fluoroalkyl group and an cationic surfactant having a fluoroalkyl group is used, an added amount of the dispersant may be reduced.

The anionic surfactant having a fluoroalkyl group is not particularly restricted and may be appropriately selected according to purpose. Examples thereof include fluoroalkylcarboxylic acid having 2 to 10 carbon atoms and a metal salt thereof, disodium perfluorooctanesulfonylglutamate, sodium 3-[ω-fluoroalkyl(C6-C11)oxy]-1-alkyl(C3-C4)sulfonate, sodium 3-[ω-fluoroalkanoyl(C6-C8)-N-ethylamino]-1-propanesulfonate, fluoroalkyl(C11-C20)carboxylic acid and a metal salt thereof, perfluoroalkyl(C7-C13)carboxylic acid and a metal salt thereof, perfluoroalkyl(C4-C12)sulfonic acid and a metal salt thereof, perfluorooctanesulfonic acid diethanol amide, N-propyl-N-(2-hydroxyethyl) perfluorooctanesulfonamide, a perfluoroalkyl(C6-C10)sulfonamidepropyltrimethylammonium salt, a perfluoroalkyl(C6-C10)-N-ethylsulfonylglycine salt and monoperfluoroalkyl(C6-C16) ethylphosphate ester. These may be used alone or in combination of two or more.

Examples of commercially available products of the anionic surfactants having a fluoroalkyl group include: SURFLON S-111, S-112, S-113 (manufactured by Asahi Glass Co., Ltd.); FLUORAD FC-93, FC-95, FC-98, FC-129 (manufactured by Sumitomo 3M); UNIDYNE DS-101, DS-102, (manufactured by Daikin Industries, Ltd.); MEGAFACE F-110, F-120, F-113, F-191, F-812, F-833 (manufactured by DIC Corporation); EFTOP EF-102, 103, 104, 105, 112, 123A, 123B, 306A, 501, 201, 204 (Tochem Products Co., Ltd.); and FTERGENT F-100, F-150 (manufactured by Neos Company Limited).

Further, the cationic surfactant having a fluoroalkyl group is not particularly restricted and may be appropriately selected according to purpose. Examples thereof include an aliphatic primary, secondary or tertiary amine acid having a fluoroalkyl group, an aliphatic quaternary ammonium salt such as perfluoroalkyl(C6-C10)sulfonamidepropyltrimethyl ammonium salt, a benzalkonium salt, benzethonium chloride, a pyridinium salt and an imidazolinium salt. These may be used alone or in combination of two or more.

Examples of commercially available products of the cationic surfactant having a fluoroalkyl group include: SURFLON S-121 (manufactured by Asahi Glass Co., Ltd.); FLUORAD FC-135 (manufactured by Sumitomo 3M); UNIDYNE DS-202 (Daikin Industries, Ltd.); MEGAFACE F-150, F-824 (manufactured by DIC Corporation); EFTOP EF-132 (Tochem Products Co., Ltd.); and FTERGENT F-300 (manufactured by Neos Company Limited).

Resin particles and/or inorganic particles may also be used as the dispersant. This suppresses association between oil droplets, and the first liquid may be uniformly dispersed.

A material constituting the resin particles is not particularly restricted and may be appropriately selected according to purpose. Examples thereof include a vinyl resin, polyurethane, an epoxy resin, polyester, a polyamide, a polyimide, a silicon-based resin, a phenol resin, a melamine resin, a urea resin, an aniline resin, an ionomer resin and polycarbonate. These may be used alone or in combination of two or more. Among these, a vinyl resin, polyurethane, an epoxy resin and polyester are preferable since aqueous dispersion of fine spherical resin particles may be easily obtained.

Examples of the vinyl resin include a styrene-(meth) acrylic acid ester copolymer, a styrene-butadiene copolymer, a (meth)acrylic acid-acrylic acid ester copolymer, a styrene-acrylonitrile copolymer, a styrene-maleic anhydride copolymer and a styrene-(meth)acrylic acid copolymer.

The resin particles include preferably a resin having a carboxyl group, more preferably a resin having a structural unit derived from (meth)acrylic acid, to fix a charge controlling agent on a surface thereof.

A material constituting the inorganic particles is not particularly restricted and may be appropriately selected according to purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. Tricalcium phosphate, calcium carbonate, colloidal titanium oxide, colloidal silica and hydroxyapatite are preferable, and hydroxyapatite synthesized by reacting sodium phosphate and calcium chloride in water under basic conditions is particularly preferable.

In the case of using a substance that is soluble in acid or alkali such as tricalcium phosphate as the dispersant, the dispersant may be removed first by dissolving the dispersant with hydrochloric acid and then by washing it with water.

As the dispersant, a polymeric protective colloid may be used.

The polymeric protective colloid is not particularly restricted and may be appropriately selected according to purpose. Examples thereof include a homopolymers or a copolymer of a monomer or a derivative thereof having a carboxyl group such as acrylic acid, methacrylic acid, α-cyanoacrylic acid, α-cyanomethacrylic acid, itaconic acid, crotonic acid, fumaric acid, maleic acid and maleic anhydride; a (meth)acrylic monomer having a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate N-methylol acrylamide and N-methylol methacrylamide; a vinyl alkyl ether such as vinyl methyl ether, vinyl ethyl ether and vinyl propyl ether; an ester of a vinyl alcohol and a carboxylic acid such as vinyl acetate, vinyl propionate and vinyl butyrate; an amide compound or a methylol thereof such as acrylamide, methacrylamide, and diacetone acrylamide acid; a monomer having a carbonyl chloride group such as acrylic acid chloride and methacrylic acid chloride; a monomer having a nitrogen atom or a heterocyclic ring thereof such as vinylpyridine, vinyl pyrrolidone, vinyl imidazole and ethylene imine.

Examples of other polymeric protective colloids include: polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester and polyoxyethylene nonyl phenyl ester; and celluloses such as methyl cellulose, hydroxyethyl cellulose and hydroxypropyl cellulose.

The particles dispersed in the second solution have a volume average particle diameter of usually 3 μm to 8 μm, preferably 3 μm to 7 μm, and particularly preferably 4 μm to 7 μm. Also, a ratio of the volume average particle diameter to a number average particle diameter of the particles dispersed in the second solution is usually 1.00 to 1.20, preferably 1.00 to 1.17, and particularly preferably 1.00 to 1.15. This may suppress occurrences of scattering or fogging in forming an image using a full-color copier, and a high-quality image having favorable developability may be formed over a long period of time.

The volume average particle diameter and the number average particle diameter of the particles dispersed in the second solution may be measured using Coulter Counter TA-II or Coulter Multisizer II (manufactured by Beckman Coulter Inc.)

<Step (c)>

The (c) is a step for forming particles by removing the organic solvent from the solution obtained in the (b) (the second solution).

Hereinafter, the (c) is explained.

A method for forming particles by removing the organic solvent from the second solution is not particularly restricted and may be appropriately selected according to purpose. Examples thereof include a method to evaporate the organic solvent by gradually increasing the temperature of the second solution and a method to evaporate the organic solvent and the first aqueous medium by spraying the second liquid in a dry atmosphere. When the organic solvent is removed by gradually increasing the temperature of the second solution, it is preferable to set mild conditions for removing the organic solvent such as temperature and pressure in order to prevent occurrence of crack-shaped voids within the toner.

In the present invention, voids within the toner are formed practically by heating of the third solution. If the thermal properties of the binder resin are not sufficient, there is a possibility that internal voids occur excessively and that sufficient image density may not be obtained. To prevent this, when the organic solvent of the second solution is removed, it is preferable to have a prepolymer having a functional group reactive with an active hydrogen group and a compound having an active hydrogen group coexist and react in the second solution. When the prepolymer having a functional group reactive with an active hydrogen group and the compound having an active hydrogen group are reacted, it is possible to set a solvent evaporation temperature of the second liquid to a high temperature to some extent that crack-shaped voids do not occur. Thereby, the resin has a longer molecular length and improved thermal properties, and excessive formation of internal voids may be prevented. However, the prepolymer used can preferably react with the compound having an active hydrogen group without heating.

The dry atmosphere in which the second liquid is sprayed is not particularly restricted and may be appropriately selected according to purpose. Examples thereof include a flow current in which air, nitrogen, carbon dioxide or combustion gas is heated. Here, the flow current is preferably heated to a temperature at or greater than the highest boiling point of the organic solvent and the first aqueous medium. In addition, when the organic solvent and the first aqueous medium are evaporated by spraying the second solution in the dry atmosphere, a spray dryer, a belt dryer or a rotary kiln may be used.

<Step (d)>

The (d) is a step for washing the particles obtained in the (c).

Hereinafter, the (d) is explained.

A method to wash the particles is not particularly restricted as long as it is possible to remove the dispersant, and it may be appropriately selected according to purpose. Examples thereof include a method to wash by adding water while filtering.

In this case, it is preferable to filter after dispersing the washed cake in water to adjust its pH to 3.0 to 6.0. Thereby, the dispersant may be efficiently removed. When the pH is less than 3.0, impurities may precipitate. When it exceeds 6.0, it may be difficult to remove the dispersant effectively. When the washing is insufficient, the resin undergoes no geometry changes because it is energetically stable due to the dispersant adhered to the toner, and it is difficult to create internal voids.

The slurry that the cake after washing (i.e. the particles obtained in (d)) has been adjusted to 25% by mass of solid content by adding water preferably has an electrical conductivity of 600 μS/cm or less, more preferably 400 μS/cm or less, and particularly preferably 200 μS/cm or less. Here the electrical conductivity of the slurry may be reduced by increasing the amount of wash water.

<Step (e)>

The (e) is a step for forming voids in the particles obtained in the (d) by heating the particles to a temperature T while or after dispersing the particles in a second aqueous medium, wherein the temperature T is between a glass transition temperature Tg of toner particles (described hereinafter) and Tg+25° C. A solution obtained in the (e) is referred to as a "third solution".

Hereinafter, the (e) is explained.

Similarly to the aqueous medium included in the first aqueous medium in the (b), the second aqueous medium used in the (e) includes water, and it may further include an organic solvent which is miscible with water.

The aqueous medium included in the first aqueous medium and the second aqueous medium may be identical to or different from each other, and they may be appropriately selected according to purpose.

The temperature T in preparing the third solution is not particularly restricted as long as it is between the glass transition temperature Tg of the toner particles and Tg+25° C., and it may be appropriately selected according to purpose. It is preferably between Tg and Tg+10° C., and more preferably Tg+5° C. and Tg+10° C. It is possible to remove organic solvent components or organic solvents remaining within the particles and to form voids within the particles by heating them to a temperature of Tg or greater. When the temperature T is less than Tg of the toner particles, internal changes in the shape of the particle do not occur, and no voids are created inside the particles. On the other hand, when the temperature T exceeds Tg+25° C., particle size distribution may degrade due to fusion within the resin, and fixing property may degrade due to reduced image density and thermal conductivity.

In this case, the temperature T indicates the maximum temperature in the heating system. When a heat exchanger is used for heating, the system has the maximum temperature right after the heat exchanger, and this temperature is defined as the temperature T in the present invention. After reaching the temperature T, the temperature is maintained for a certain period of time.

Here, the glass transition temperature Tg of the toner particles is a glass transition temperature after a first heating in a differential scanning calorimetry (DSC).

The Tg may be measured, for example, by a DSC system (differential scanning calorimeter) ("DSC-60A", manufactured by Shimadzu Corporation).

Specifically, the glass transition temperature of a target sample may be measured by the following procedure.

First, about 10 mg of the target sample is placed in an aluminum cell, which is placed on a sample tray. Next, a DSC measurement is performed by heating under a nitrogen atmosphere from a room temperature to 150° C. at a heating speed of 10° C./min. In an obtained DSC curve (i.e. a DSC curve of the first heating), Tg may be calculated from the contact between a tangent of an endothermic curve derived from the target sample and the base line.

Here, the time for heating to a predetermined temperature T in preparing the third solution is not particularly restricted as long as the toner has a cross-sectional void fraction Sp/St of 0.1% to 15.0%, and it may be appropriately selected according to purpose. It is usually 5 minutes to 60 minutes.

Also, the time maintained at the predetermined temperature T in preparing the third solution is not particularly restricted as long as the toner has a cross-sectional void fraction Sp/St of 0.1% to 15.0%, and it may be appropriately selected according to purpose. It is usually 5 minutes to 180 minutes.

<Step (f)>

The (f) is a step for forming the toner base particles by adding a charge controlling agent to a solution (the third solution) obtained in the (e).

Hereinafter, the (f) is explained.

—Charge Controlling Agent—

The charge controlling agent added to the third solution is not particularly restricted and may be appropriately selected according to purpose. Examples thereof include nigrosine dyes, triphenylmethane dyes, chromium-containing metal complex dyes, molybdic acid chelate pigments, rhodamine dyes, alkoxy amines, quaternary ammonium salts, alkyl amides, elemental phosphorus or phosphorus compound, elemental tungsten or tungsten compounds, fluorine surfactants, metal salts of salicylic acid, metal salts of salicylic acid derivatives, copper phthalocyanine, perylene, quinacridone, azo pigments, polymeric compounds having a functional group such as sulfonic acid group, carboxyl group and quaternary ammonium salt group.

Examples of commercially available products of the charge controlling agent include: BONTRON 03 of a nigrosine dye, BONTRON P-51 of a quaternary ammonium salt, BONTRON S-34 of a metal-containing azo dye, BONTRON E-82 of an oxynaphthoic acid metal complex, BONTRON E-84 of a salicylic acid metal complex, BONTRON E-89 of a phenol condensate (Orient Chemical Industries Co., Ltd.); TP-302, TP-415 of quaternary ammonium salt molybdenum complexes (manufactured by Hodogaya Chemical Co., Ltd.); Copy charge PSY VP2038 of a quaternary ammonium salt, Copy Blue PR of a triphenylmethane derivative, Copy Charge NEG VP2036, Copy Charge NX VP434 of quaternary ammonium salts, (manufactured by Clariant (Japan) K.K.); and LRA-901 and LR-147 as a boron complex (manufactured by Carlit Japan Co., Ltd.).

The charge controlling agent is preferably a quaternary ammonium salt having a fluoro group in view of fixing it uniformly on a surface of the toner base particles included in the third solution. The quaternary ammonium salt having a fluoro group is preferable since it easily dissolves in water including alcohol as well as it has excellent affinity to a carboxyl group.

The quaternary ammonium salt having a fluoro group may be used in combination with a metal-containing azo dye.

The quaternary ammonium salt having a fluoro group is not particularly restricted and may be appropriately selected according to purpose. Examples thereof include a compound represented by a general formula below.

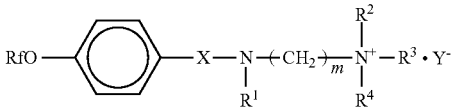

(in the formula, Rf is a perfluoroalkyl group; X is a divalent organic group; each of $R^1$ to $R^4$ is independently a hydrogen atom, a hydrocarbon group or a fluoroalkyl group; $Y^-$ is a counter ion; and m is an integer of 1 or greater.

These may be used alone or in combination of two or more.

The number of carbon atoms in Rf is usually 3 to 60, preferably 3 to 30, and more preferably 3 to 15. Rf is not particularly restricted and may be appropriately selected according to purpose. Examples thereof include $CF_3(CF_2)_5$—, $CF_3(CF_2)_6$—, $CF_3(CF_2)_7$—, $CF_3(CF_2)_8$—, $CF_3(CF_2)_9$—, $CF_3(CF_2)_{10}$—, $CF_3(CF_2)_{11}$—, $CF_3(CF_2)_{12}$—, $CF_3(CF_2)_{13}$—, $CF_3(CF_2)_{14}$—, $CF_3(CF_2)_{15}$—, $CF_3(CF_2)_{16}$—, $CF_3(CF_2)_{17}$— and $(CF_3)_2CF(CF_2)_6$—.

$Y^-$ is not particularly restricted and may be appropriately selected according to purpose. Examples thereof include a halide ion, a sulfate ion, a nitrate ion, a phosphate ion, a thiocyanate ion and an organic acid ion. Among these, a halide ion such as fluoride ion, chloride ion, bromide ion and iodide ion is preferable.

X is not particularly restricted and may be appropriately selected according to purpose. Examples thereof include —$SO_2$—, —CO—, —$(CH_2)_x$—, —$SO_2N(R^5)$—$(CH_2)_x$— and —$(CH_2)_x$—CH(OH)—$(CH_2)_x$—. Here, x is an integer of 1 to 6, and $R^5$ is an alkyl group having 1 to 10 carbon atoms. Among these, —$SO_2$—, —CO—, —$(CH_2)_2$—, —$SO_2N(C_2H_5)$—$(CH_2)_2$— or —$CH_2CH(OH)CH_2$— is preferable, and —$SO_2$— or —CO— is particularly preferable.

In the above formula, m is preferably 1 to 20, and more preferably 1 to 10.

The hydrocarbon group in $R^1$ to $R^4$ is not particularly restricted and may be appropriately selected according to purpose. Examples thereof include an alkyl group, an alkenyl group and an aryl group, and these may be substituted by a substituent.

The alkyl group preferably has 1 to 10 carbon atoms. The alkyl group is not particularly restricted and may be appropriately selected according to purpose. Examples thereof include methyl group, ethyl group, n-propyl group, isopropyl group, n-butyl group, isobutyl group, sec-butyl group, n-hexyl group, isohexyl group, n-heptyl group, n-octyl group, isooctyl group, n-decyl group and isodecyl group.

The alkenyl group preferably has 2 to 10 carbon atoms. The alkenyl group is not particularly restricted and may be appropriately selected according to purpose. Examples thereof include vinyl group, allyl group, propenyl group, isopropenyl group, butenyl group, hexenyl group and octenyl group.

The aryl group preferably has 6 to 24 carbon atoms. The aryl group is not particularly restricted and may be appropriately selected according to purpose. Examples thereof include phenyl group, tolyl group, xylyl group, cumenyl group, styryl group, mesityl group, a cinnamyl group, phenethyl group and benzhydryl group.

An added amount of the charge controlling agent with respect to the total amount of the binder resin and/or the precursor of a binder resin is usually 0.1% by mass to 10% by mass, and preferably 0.2% by mass to 5% by mass. When the added amount of the charge controlling agent exceeds 10% by mass, electrostatic attraction between a developing roller and the toner increases. This may reduce fluidity of the toner or reduce image density.

<Step (g)>

The (g) is a step for adding an external additive to the toner base particles to obtain toner particles. The external additive is not particularly restricted and may be appropriately selected according to purpose. Examples thereof include a fluidity improving agent and a cleanability improving agent.

Hereinafter, the (g) is explained.

—Fluidity Improving Agent—

A material constituting the fluidity improving agent is not particularly restricted and may be appropriately selected according to purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

The fluidity improving agent has a primary diameter of usually 5 nm to 2 μm, and preferably 5 nm to 500 nm. Also, the fluidity improving agent has a BET specific surface area of usually 20 $m^2/g$ to 500 $m^2/g$.

A content of the fluidity improving agent in the toner is usually 0.01% by mass to 5% by mass, and preferably 0.01% by mass to 2% by mass.

It is preferable to improve hydrophobicity of the fluidity improving agent using a surface treatment agent. The surface treatment agent is not particularly restricted and may be appropriately selected according to purpose. Examples thereof include a silane coupling agent, a silylating agent, a silane coupling agent having a fluorinated alkyl group, an organic titanate coupling agent, an aluminum-based coupling agent, a silicone oil and a modified silicone oil.

—Cleanability Improving Agent—

The cleanability improving agent is not particularly restricted and may be appropriately selected according to purpose. Examples thereof include: a fatty acid metal salt such as zinc stearate and calcium stearate; and resin particles such as polymethylmethacrylate particles and polystyrene particles.

The resin particles usually have a narrow particle size distribution and have a volume average particle diameter of 0.01 μm to 1 μm.

An external additive may be fixed on a surface of the toner base particles by mixing the toner base particles with the external additive and applying a mechanical impact on the mixture according to necessity.

A method to apply the mechanical impact on the mixture is not particularly restricted and may be appropriately selected according to purpose. Examples thereof include a method to apply an impact on the mixture using a blade rotating at high speed and a method to have the mixture or a composite of the mixture collide against a collision plate by placing the mixture in a high-speed flow current for acceleration.

Examples of an apparatus for applying the mechanical impact on the mixture include ANGMILL (manufactured by Hosokawa Micron Co., Ltd.), a remodeled apparatus of I-TYPE MILL with a reduced grinding air pressure (manufactured by Nippon Pneumatic Mfg. Co., Ltd.), HYBRIDIZATION SYSTEM (manufactured by Nara Kikai Seisakusho Co., Ltd.), KRYPTRON SERIES (manufactured by Kawasaki Heavy Industries, Ltd.) and an automatic mortar.

<Other Steps>

Other steps include filtering and drying the toner base particles produced by adding the charge controlling agent to the third solution.

(Toner)

A toner of the present invention is a toner obtained by the method for manufacturing a toner of the present invention described above.

The toner includes spherical voids, does not include crack-shaped voids and has a cross-sectional void fraction Sp/St of 0.1% to 15.0%. Accordingly, sufficient image density may be achieved, an amount of the toner adhered to a unit area of a recording medium such as paper may be reduced, and occurrence of carrier spent may be prevented.

The toner of the present invention may be used as a two-component developer by mixing it with a carrier. Here, a mass ratio of the toner with respect to the carrier is usually 1% by mass to 10% by mass, and preferably 3% by mass to 9% by mass.

The carrier is not particularly restricted and may be appropriately selected according to purpose. Examples thereof include powders having a particle diameter of 20 μm to 200 μm such as iron powder, ferrite powder and magnetite powder.

Also, the carrier may have a coating layer formed on a surface thereof. A material constituting the coating layer is not particularly restricted and may be appropriately selected according to purpose. Examples thereof include: an amino resin such as urea-formaldehyde resin, melamine resin, benzoguanamine resin, urea resin, polyamide resin and epoxy resin; a polystyrene resin such as acrylic resin, polymethylmethacrylate, polyacrylonitrile, polyvinyl acetate, polyvinyl alcohol, polyvinyl butyral, polystyrene and styrene-acrylic copolymer; a halogenated olefin resin such as polyvinyl chloride; polyethylene; polyvinyl and polyvinylidene resins such as polyvinyl fluoride, polyvinylidene fluoride, polytrifluoroethylene, polyhexafluoropropylene, vinylidene fluoride/acrylic copolymer, vinylidene fluoride/vinyl fluoride copolymer, fluoro-terpolymer (e.g. terpolymer of tetrafluoroethylene, vinylidene fluoride and non-fluorinated monomer); polyester such as polyethylene terephthalate and polybutylene terephthalate; polycarbonates; and a silicone resin.

Also, the coating layer may include an electroconductive powder according to necessity. A material constituting the electroconductive powder is not particularly restricted and may be appropriately selected according to purpose. Examples thereof include metal powder, carbon black, titanium oxide, tin oxide and zinc oxide.

The electroconductive powder has an average particle diameter of usually 1 μm or less. When the average particle diameter of the electroconductive powder exceeds 1 μm, it may become difficult to control the electrical resistance of the coating layer.

The toner manufactured using a method for manufacturing a toner of the present invention may be used as a magnetic one-component developer or a non-magnetic one-component developer without mixing it with a carrier.

(Image Forming Method)

In an image forming method including at least forming an electrostatic latent image, developing, transferring and fixing, a toner of the present invention or a developer that the toner is mixed with a carrier is used in the developing where an electrostatic latent image formed on an electrostatic latent image bearing member. The electrostatic latent image is formed by charging uniformly a surface of the electrostatic latent image bearing member using a charger and then by performing an exposure corresponding to an image to be formed.

The electrostatic latent image thereby formed on the electrostatic latent image bearing member is developed with a contact or non-contact method in the developing using the toner of the present invention or the developer that the toner and the carrier are mixed, and thus a toner image is formed on the bearing member.

The toner image formed thereby is transferred to a recording medium in the transferring. When the toner of the present invention is a full-color toner, a secondary transfer method is preferable, where toner images formed with respective colors of the toner are sequentially transferred to an intermediate transfer member to form a composite color image, and the composite color image is then transferred to a recording medium. Thereafter, the toner image transferred on the recording medium is fixed on the recording medium in the fixing by a heating or a pressurizing means.

EXAMPLES

Hereinafter, the present invention will be further described in detail with reference to Examples, which however shall not be construed as limiting the scope of the present invention. Note that the unit "part(s)" in Examples means "part(s) by mass".

Preparation of First Liquid

Production Example 1

First Liquid (a1)

In a tank, 170 parts of 35-% by mass dispersion of carnauba wax in ethyl acetate, 120 parts of styrene-methyl acrylate copolymer, 20 parts of yellow pigment PY155 (manufactured by Clariant (Japan) K.K.), 70 parts of ethyl acetate, and 2 parts of isophoronediamine were placed and mixed with stirring for two hours. This was then circulated and mixed for 1 hour using a high-efficiency dispersion equipment, EBARA MILDER (manufactured by Ebara Corporation), and First Solution (a1) was obtained. The styrene-methyl acrylate copolymer as a binder resin had an acid value of 15 KOHmg/g.

Production Example 2

First Solution (a2)

First Solution (a2) of Production Example 2 was obtained in the same manner as First Solution (a1) except that a polyester resin was used instead of the styrene-methyl acrylate copolymer in Production Example 1. The polyester resin as a binder resin had an acid value of 15 KOHmg/g.

Production Example 3

First Solution (a3)

First Solution (a3) of Production Example 3 was obtained in the same manner as First Solution (a2) except that a polyester resin having an acid value of 1 KOHmg/g was used instead of the polyester resin having an acid value of 15 KOHmg/g in Production Example 2.

Production Example 4

First Solution (b)

—Production of Prepolymer—

In a reactor with a cooling tube, a stirrer and a nitrogen inlet tube, 795 parts of ethylene oxide 2-mole adduct of bisphenol A, 200 parts of isophthalic acid, 65 parts of terephthalic acid, and 2 parts of dibutyl tin oxide were introduced, which were subjected to condensation reaction under a stream of nitrogen for 8 hours at a normal pressure and 210° C. Next, the reaction was continued for 5 hours with dehydration under a reduced pressure of 10 mmHg to 15 mmHg. This was cooled to 80° C. and then reacted for 2 hours with 170 parts of isophorone diisocyanate in ethyl acetate, and Prepolymer (1) was obtained.

Also, in a separate tank, 25 parts of Prepolymer (1) and 25 parts of ethyl acetate were placed, which was stirred and mixed for 4 hours, and First Solution (b) was obtained.

Preparation of First Aqueous Medium

In a tank, 945 parts of water, 40 parts of 20-% by mass aqueous dispersion of styrene-methacrylic acid-butyl acrylate copolymer, 160 parts of 50-% by mass aqueous solution of sodium dodecyl diphenyl ether disulfonate, ELEMINOL MON-7 (manufactured by Sanyo Chemical Industries, Ltd.) and 90 parts of ethyl acetate were stirred and mixed, and First Aqueous Medium (1) was obtained.

Example 1

To a pipeline homomixer (manufactured by PRIMIX Corporation), First Solution (a1), First Solution (b) and First Aqueous Medium (1) were supplied at 3,560 g/min, 440 g/min and 6,000 g/min, respectively, and a second solution was obtained. Particles dispersed in the second solution had a volume average particle diameter of 5.9 μm and a ratio of the volume average particle diameter to a number average particle diameter of 1.13.

Next, the second solution was subjected to solvent removal at 20° C. for 2 hours until a concentration of the solvent remaining in the dispersed particles in the second solution was 12% by mass or less. This was then heated to 45° C., and the organic solvent was removed under atmospheric pressure (101.3 kPa) for 5 hours while a stirring blade was rotated at a circumferential speed at its outer peripheral edge of 10.5 m/sec. Particles were formed thereby, and Slurry (1) was obtained. Further, Slurry (1) was subjected to pressure filtration with a filter press and penetration washing, and Filter Cake (1) was obtained. Then, Filter Cake (1) was added with water such that a solid content thereof was 20% by mass, dispersed with a disper, added with 10-% by mass hydrochloric acid such that a pH thereof was 4.0 and washed for 30 minutes, and thus a wash solution was obtained. Next, the wash solution was subjected to pressure filtration and penetration washing, and Filter Cake (2) was obtained. Next, Filter Cake (2) was added with water such that a solid content thereof was 20% by mass and dispersed with a disper, and thus Wash Slurry (1) was obtained. An electrical conductivity of Wash Slurry (1) was controlled to be 500 μS/cm. Further, using a heat exchanger, Wash Slurry (1) was heated to 65° C., maintained for 30 minutes and cooled to 25° C., and Third Solution (1) was obtained.

Next, Third Solution (1) was added with water such that a solid content thereof was 20% by mass and mixed with a disper. Then, 1-% by mass methanol solution of FTERGENT 310 as N,N,N-trimethyl-[3-(4-perfluorononenyloxybenzamide)propyl]ammonium iodide), (manufactured by Neos Company Limited) was added and stirred for 30 minutes. Thereby, toner base particles were generated, and Slurry (2) was obtained. Further, Slurry (2) was subjected to solid-liquid separation using a centrifuge and dried at 40° C. for 24 hours with a vacuum drier.

Next, 0.5 parts of hydrophobic silica H2000 (manufactured by Clariant (Japan) K.K.) was added to 100 parts of the toner base particles and mixed with a HENSCHEL MIXER. Further, 0.5 parts of hydrophobic silica H2000 (manufactured by Clariant (Japan) K.K.) and 0.5 parts of hydrophobic titanium oxide MT150IB (TAYCA CORPORATION) were added and mixed with a HENSCHEL MIXER. Then, coarse particles were removed using a screen having an aperture of 37 μm, and a toner of Example 1 was obtained.

The obtained toner was measured for its cross-sectional void fraction and Tg as follows.

<Measurement of Toner Void Fraction>

The toner was fixed and held on a support by embedding it in an epoxy resin, and a surface of the toner-embedded resin was smoothened using an ultramicrotome (RM2265, manufactured by Leica Incorporated). Then, a picture of the surface of the resin on the support was taken using a scanning electron microscope (ULTRA55, manufactured by Carl Zeiss).

Three or more average views were measured and evaluated for size and distribution of particles and the voids using an image analysis software (LUZEX AP, Nireco Co., Ltd.). Using a sum of cross-sectional area of all the toner particles in one view with the cross-sectional area of the toner particles as St and a sum of cross-sectional area of voids of all the toner particles in one view with the cross-sectional area of the voids of the toner particles as Sp, a cross-sectional void fraction Sp/St was calculated as an area ratio (%) of the voids with respect to the toner area. Nearly 100 or more particles as toner particles (3 fields) were analyzed per sample. FIG. 1 is an FE-SEM image of a cross-sectional area of the toner of Example 1.

Black portions in the FE-SEM image in FIG. 1 are voids inside the toner particles, and the toner of Example 1 had a cross-sectional void fraction of 5.2%.

The glass transition temperature Tg was measured using a differential scanning calorimetry (DSC) apparatus "DSC-60A" (Shimadzu Corporation). About 10 mg of a sample was placed in an aluminum cell, which was placed on a sample tray. A DSC measurement was performed by heating from a room temperature to 150° C. at a heating speed of 10° C./min. A DSC curve of Tg to be analyzed was the first DSC heating curve, and Tg was calculated from a contact between a tangent of an endothermic curve derived from the target sample and the base line.

Example 2

A toner of Example 2 was obtained by preparing Third Solution (2) in the same manner as Example 1 except that First Solution (a2) was used instead of First Solution (a1) in Example 1.

The toner had a cross-sectional void fraction of 5.3%.

Example 3

To a pipeline homomixer (manufactured by PRIMIX Corporation), First Solution (a2), First Solution (b) and First Aqueous Medium (1) were supplied at 3,560 g/min, 440 g/min and 6,000 g/min, respectively, and a second solution was obtained. Particles dispersed in the second solution had a volume average particle diameter of 5.9 μm and a ratio of the volume average particle diameter to a number average particle diameter of 1.13. Next, the second solution was subjected to solvent removal at 20° C. for 2 hours until a concentration of the solvent remaining in the dispersed particles in the second solution was 12% by mass or less. This was then heated to 45° C., and the organic solvent was removed under atmospheric pressure (101.3 kPa) for 5 hours while a stirring blade was rotated at a circumferential speed at its outer peripheral edge of 10.5 m/sec. Particles were formed thereby, and Slurry (1) was obtained. Further, Slurry (1) was subjected to pressure filtration with a filter press and penetration washing, and Filter Cake (1) was obtained. Then, Filter Cake (1) was added with water such that a solid content thereof was 20% by mass, dispersed with a disper, added with 10-% by mass hydrochloric acid such that a pH thereof was 4.0 and washed for 30 minutes, and thus a wash solution was obtained. Next, the wash solution was subjected to pressure filtration and penetration washing, and Filter Cake (2) was obtained. At this time, washing water was twice as that of Example 2. Next, Filter Cake (2) was added with water such that a solid content thereof was 25% by mass and dispersed with a disper, and thus Wash Slurry (1) was obtained. An electrical conductivity of Wash Slurry (1) was controlled to be 100 μS/cm. Further, using a heat exchanger, Wash Slurry (1) was heated to 55° C., maintained for 30 minutes and cooled to 25° C., and Third Solution (3) was obtained. A toner of Example 3 was obtained in the same manner as Example 2 except that Third Solution (3) was used instead of Third Solution (2) in Example 2. The toner had a cross-sectional void fraction of 7.9%.

Example 4

To a pipeline homomixer (manufactured by PRIMIX Corporation), First Solution (a2), First Solution (b) and First Aqueous Medium (1) were supplied at 3,560 g/min, 440 g/min and 6,000 g/min, respectively, and a second solution was obtained. Particles dispersed in the second solution had a volume average particle diameter of 5.9 μm and a ratio of the volume average particle diameter to a number average particle diameter of 1.13. Next, the second solution was subjected to solvent removal at 20° C. for 2 hours until a concentration of the solvent remaining in the dispersed particles in the second solution was 12% by mass or less. Then, without heating, the organic solvent was removed under atmospheric pressure (101.3 kPa) for 5 hours while a stirring blade was rotated at a circumferential speed at its outer peripheral edge of 10.5 m/sec. Particles were formed thereby, and Slurry (1) was obtained. Further, Slurry (1) was subjected to pressure filtration with a filter press and penetration washing, and Filter Cake (1) was obtained. Then, Filter Cake (1) was added with water such that a solid content thereof was 20% by mass, dispersed with a disper, added with 10-% by mass hydrochloric acid such that a pH thereof was 4.0 and washed for 30 minutes, and thus a wash solution was obtained. Next, the wash solution was subjected to pressure filtration and penetration washing, and Filter Cake (2) was obtained. Next, Filter Cake (2) was added with water such that a solid content thereof was 25% by mass and dispersed with a disper, and thus Wash Slurry (1) was obtained. Wash Slurry (1) had an electrical conductivity of 100 μS/cm. Further, using a heat exchanger, Wash Slurry (1) was heated to 45° C., maintained for 30 minutes and cooled to 25° C., and Third Solution (4) was obtained.

A toner of Example 4 was obtained in the same manner as Example 2 except that Third Solution (4) was used instead of Third Solution (2) in Example 2. The toner had a cross-sectional void fraction of 10.2%.

Example 5

A toner of Example 5 was obtained by preparing Third Solution (5) in the same manner as Example 2 except that First Solution (a3) was used instead of First Solution (a2) in Example 2. The toner had a cross-sectional void fraction of 4.9%.

Comparative Example 1

A toner of Comparative Example 1 was obtained by preparing Third Solution (6) in the same manner as Example 2 except that, in preparing Third Solution (2) in Example 2, Wash Slurry (1) was heated to 40° C., maintained for 600 minutes and cooled to 25° C. using a heat exchanger. The toner had a cross-sectional void fraction of 0.04%.

Comparative Example 2

A toner of Comparative Example 2 was obtained by preparing Third Solution (7) in the same manner as Example 2 except that, in preparing Third Solution (2) in Example 2, Wash Slurry (1) was heated to 75° C., maintained for 180 minutes and cooled to 25° C. using a heat exchanger. The toner had a cross-sectional void fraction of 17.2%.

Comparative Example 3

To a pipeline homomixer (manufactured by PRIMIX Corporation), First Solution (a2), First Solution (b) and First Aqueous Medium (1) were supplied at 3,560 g/min, 440 g/min and 6,000 g/min, respectively, and a second solution was obtained. Particles dispersed in the second solution had a volume average particle diameter of 5.9 μm and a ratio of the volume average particle diameter to a number average particle diameter of 1.13. Next, the second solution was subjected to solvent removal at 30° C. for 12 hours until a concentration of the solvent remaining in the dispersed particles in the second solution was 12% by mass or less. This was then heated to 45° C., and the organic solvent was removed under atmospheric pressure (101.3 kPa) for 5 hours while a stirring blade was rotated at a circumferential speed at its outer peripheral edge of 10.5 m/sec. Particles were formed thereby, and Slurry (1) was obtained. Further, Slurry (1) was subjected to pressure filtration with a filter press and penetration washing, and Filter. Cake (1) was obtained. Then, Filter Cake (1) was added with water such that a solid content thereof was 20% by mass, dispersed with a disper, added with 10-% by mass hydrochloric acid such that a pH thereof was 4.0 and washed for 30 minutes, and thus a wash solution was obtained. Next, the wash solution was subjected to pressure filtration and penetration washing, and Filter Cake (2) was obtained. Next, Filter Cake (2) was added with water such that a solid content thereof was 25% by mass and dispersed with a disper, and thus Wash Slurry (1) was obtained. Thus obtained Wash Slurry (1) had an electrical conductivity of 500 μS/cm. Without heating or aging Wash Slurry (1), Third Solution (8) was obtained.

A toner of Comparative Example 3 was obtained in the same manner as Example 2 except that, Third Solution (8) was used instead of Third Solution (2) in Example 2. The toner had a cross-sectional void fraction of 10.1%.

Table 1 shows the manufacturing conditions of the toners as well as the cross-sectional void fraction of the toners obtained in Examples 1 to 5 and Comparative Examples 1 to 3.

—Image Evaluation—

Each developer obtained was set in an image forming apparatus (IPSIO color 8000, manufactured by Ricoh Company, Ltd.). Fifty thousand (50,000) sheets of a chart having an image area ratio of 5% were consecutively printed out, and the following evaluations were conducted.

The results are shown in Table 2.

<Measurement of Image Density>

After printing out the chart, image density was measured at five points using X-RITE 939 (manufactured by X-Rite, Incorporated), and an average value was found and evaluated based on the following criteria.

Here, image density of 1.4 or greater is practically usable.

[Evaluation Criteria]

A: image density of 1.5 or greater

B: image density of 1.4 or greater and less than 1.5

C: image density of less than 1.4

TABLE 1

| | | | Removing organic solvent (c) | | | | Forming voids in particles | | |
|---|---|---|---|---|---|---|---|---|---|
| | Toner particles Tg (° C.) | Binder resin acid value (KOH mg/g) | Time for residual solvent in particles to reach concentration of 12% by mass (hour) | Liquid temperature for residual solvent in particles to reach concentration of 12% by mass (° C.) | Liquid temperature after concentration of residual solvent in particles to reach 12% by mass (° C.) | Electrical conductivity in 25% by mass slurry of particles obtained in (d) (μS/cm) | Heating temperature (° C.) | Heating Time (minutes) | Cross-sectional void fraction of toner (%) |
| Ex. 1 | 55 | 15 | 2 | 20 | 45 | 500 | 65 | 30 | 5.2 |
| Ex. 2 | 45 | 15 | 2 | 20 | 45 | 500 | 55 | 30 | 5.3 |
| Ex. 3 | 45 | 15 | 2 | 20 | 45 | 100 | 55 | 30 | 7.9 |
| Ex. 4 | 45 | 15 | 2 | 20 | 20 | 500 | 45 | 30 | 10.2 |
| Ex. 5 | 45 | 1 | 2 | 20 | 45 | 500 | 55 | 30 | 4.9 |
| Comp. Ex. 1 | 45 | 15 | 2 | 20 | 45 | 500 | 40 | 600 | 0.04 |
| Comp. Ex. 2 | 45 | 15 | 2 | 20 | 45 | 500 | 75 | 10 | 17.2 |
| Comp. Ex. 3 | 45 | 15 | 12 | 30 | 45 | 500 | — | — | 10.1 |

—Preparation of Carrier—

A coating solution was prepared by dispersing a coating material having the following composition with a stirrer for 10 minutes. The coating solution was applied on a core material by placing the coating solution and the core material in a coating apparatus, which was equipped with a rotating bottom-plate disk and stirring blades in a fluidized bed and performed coating while forming a swirl flow. An obtained coated material was baked at 250° C. for 2 hours, and a carrier was prepared.

Mn ferrite particles as the core material (weight-average particle diameter=35 μm) . . . 5,000 parts Composition of Coating Material Toluene . . . 450 parts Silicone resin (product name: SR2400, manufactured by Dow Corning Toray Co., Ltd., having a non-volatile content of 50%) . . . 450 parts Aminosilane (product name: SH6020, manufactured by Dow Corning Toray Co., Ltd.) . . . 10 parts Carbon black . . . 10 parts —Preparation of Developer—

Using the ferrite carrier having an average particle diameter of 35 μm, which was coated with the silicone resin with an average thickness of 0.5 μm, 7 parts of each toner with respect to 100 parts of the carrier was uniformly mixed and charged using a TURBULA MIXER that a content was stirred by a rolling container, and a developer was prepared.

<Evaluation of Toner Adhered Amount>

A toner adhered amount was evaluated, which is required for obtaining the image density.

A solid image of 2 cm×2 cm was formed on a developing sleeve. Without transferring to paper, it was peeled off from the developing sleeve using a commercially available double-sided tape. A toner adhesion amount per unit area (mg/cm$^2$) was measured from the mass of the double-sided tape before and after the toner adhesion and evaluated based on the following criteria.

[Evaluation Criteria]

B: less than 0.4 mg/cm$^2$ (required image density is obtained despite a small amount of a toner)

C: 0.4 mg/cm$^2$ or greater (a large amount of toner is required for sufficient image density)

<Evaluation of Carrier Spent Property>

The developer was subjected to a blow-off treatment after printing out 50,000 sheets, and a mass of the remaining carrier was weighed as W1. This carrier was soaked in a solvent to remove materials adhering to a surface of the carrier and then dried, and a mass of the carrier was weighed as W2. Finally, the carrier spent property was found from the following formula.

$$\text{Carrier spent property (\%)}=(W1-W2)/W1\times 100$$

[Evaluation Criteria]

B: less than 0.1%

C: 0.1% or greater (the carrier is contaminated and sufficient charging amount cannot be obtained)

Table 2 shows the evaluation results of the toners of Examples 1 to 5 and Comparative Examples 1 to 3.

TABLE 2

| | Cross-sectional void fraction of toner (%) | Image density | Toner adhered amount | Carrier spent property |
|---|---|---|---|---|
| Ex. 1 | 5.2 | B | B | B |
| Ex. 2 | 5.3 | A | B | B |
| Ex. 3 | 7.9 | A | B | B |
| Ex. 4 | 10.2 | B | B | B |
| Ex. 5 | 4.9 | B | B | B |
| Comp. Ex. 1 | 0.04 | A | C | B |
| Comp. Ex. 2 | 17.2 | C | B | C |
| Comp. Ex. 3 | 10.1 | B | B | C |

As observed in Table 2, with the toners of the present invention, sufficient image density may be achieved, an amount of the toner adhered to a unit area of a recording medium such as paper may be reduced, and occurrence of carrier spent may be prevented.

Aspects of the present invention are as follows.

<1> A method for manufacturing a toner, including at least:

(a) dissolving or dispersing a toner material including at least any one of a binder resin and a precursor of a binder resin in an organic solvent;

(b) dispersing a solution obtained in the (a) in a first aqueous medium including a dispersant;

(c) forming particles by removing the organic solvent from the solution obtained in the (b);

(d) washing the particles obtained in the (c);

(e) forming voids in the particles obtained in the (d) by heating the particles to a temperature T while or after dispersing the particles in a second aqueous medium;

(f) forming toner base particles by adding a charge controlling agent to a solution obtained in the (e); and (g) adding an external additive to the toner base particles to obtain toner particles, wherein the temperature T in the (e) is between a glass transition temperature Tg of the toner particles and Tg+25° C., and wherein the toner has a cross-sectional void fraction Sp/St of 0.1% to 15.0%, where St is a cross-sectional area of the toner particles, and Sp is a cross-sectional area of the voids.

<2> The method for manufacturing a toner according to <1>, wherein the cross-sectional void fraction Sp/St is 3.0% to 8.0%.

<3> The method for manufacturing a toner according to any one of <1> to <2>, wherein the temperature T is Tg+5° C. or greater, and Tg+10° C. or less.

<4> The method for manufacturing a toner according to any one of <1> to <3>, wherein, the (d) includes in recited order:

washing the particles obtained in the (c) with water;

dispersing the particles in water;

washing the particles while adjusting a pH to 3.0 to 6.0; and filtering.

<5> The method for manufacturing a toner according to any one of <1> to <4>, wherein the binder resin includes polyester.

<6> The method for manufacturing a toner according to any one of <1> to <5>, wherein the precursor of a binder resin includes a prepolymer having a functional group reactive with an active hydrogen group, and wherein the prepolymer having a functional group reactive with an active hydrogen group is reacted with a compound having an active hydrogen group when the organic solvent is removed from the solution obtained in the (b).

<7> The method for manufacturing a toner according to any one of <1> to <6>, wherein a slurry adjusted to 25% of a solid content by mass by adding water to the particles obtained in the (d) has an electrical conductivity of 400 μS/cm or less.

<8> The method for manufacturing a toner according to any one of <1> to <7>, wherein the binder resin has an acid value of 2 KOHmg/g to 30 KOHmg/g.

<9> A toner obtained by the method for manufacturing a toner according to any one of <1> to <8>.

<10> An image forming method, including at least:

forming an electrostatic latent image;

developing;

transferring; and fixing, wherein an electrostatic latent image formed on an electrostatic latent image bearing member is developed using the toner according to <9>.

This application claims priority to Japanese application No. 2011-199565, filed on Sep. 13, 2011 and incorporated herein by reference.

The invention claimed is:

1. A method for manufacturing a toner, the method comprising:

(a) dissolving or dispersing a toner material comprising a binder resin, a precursor of a binder resin, or both, in an organic solvent;

(b) dispersing a solution obtained in (a) in a first aqueous medium comprising a dispersant;

(c) forming particles by removing the organic solvent from a solution obtained in (b);

(d) washing the particles obtained in (c);

(e) forming voids in the particles obtained in (d) by heating the particles to a temperature T while or after dispersing the particles in a second aqueous medium;

(f) forming toner base particles by adding a charge controlling agent to a solution obtained in (e); and (g) adding an external additive to the toner base particles to obtain toner particles, wherein the temperature T in (e) is between a glass transition temperature Tg of the toner particles and Tg+25° C., and wherein the toner has a cross-sectional void fraction Sp/St of 0.1% to 15.0%, where St is a cross-sectional area of the toner particles, and Sp is a cross-sectional area of the voids.

2. The method of claim 1, wherein the cross-sectional void fraction Sp/St is 3.0% to 8.0%.

3. The method of claim 2, wherein the temperature T is Tg+5° C. or greater, and Tg+10° C. or less.

4. The method of claim 1, wherein the temperature T is Tg+5° C. or greater, and Tg+10° C. or less.

5. The method of claim 1, wherein, (d) comprises in recited order:

washing the particles obtained in (c) with water;

dispersing the particles in water;

washing the particles while adjusting a pH to 3.0 to 6.0; and filtering.

6. The method of claim 1, wherein the binder resin comprises polyester.

7. The method of claim 1, wherein the toner material comprises a precursor of a binder resin, and the precursor of a binder resin comprises a prepolymer having a functional group reactive with an active hydrogen group, and wherein the prepolymer having a functional group reactive with an active hydrogen group is reacted with a compound having an active hydrogen group when the organic solvent is removed from the solution obtained in (b).

8. The method of claim 1, wherein a slurry adjusted to 25% by mass of a solid content by adding water to the particles obtained in (d) has an electrical conductivity of 400 μS/cm or less.

9. The method of claim 1, wherein the binder resin has an acid value of 2 KOHmg/g to 30 KOHmg/g.

10. The method of claim 1, comprising (a) dissolving or dispersing a toner material comprising a binder resin in an organic solvent.

11. The method of claim 1, comprising (a) dissolving or dispersing a toner material comprising a precursor of a binder resin in an organic solvent.

12. The method of claim 1, comprising (a) dissolving or dispersing a toner material comprising both a binder resin and a precursor of a binder resin in an organic solvent.

13. A toner obtained by a method comprising:

(a) dissolving or dispersing a toner material comprising a binder resin, a precursor of a binder resin, or both, in an organic solvent;

(b) dispersing a solution obtained in (a) in a first aqueous medium comprising a dispersant;

(c) forming particles by removing the organic solvent from a solution obtained in (b);

(d) washing the particles obtained in (c);

(e) forming voids in the particles obtained in (d) by heating the particles to a temperature T while or after dispersing the particles in a second aqueous medium;

(f) forming toner base particles by adding a charge controlling agent to a solution obtained in (e); and (g) adding an external additive to the toner base particles to obtain toner particles, wherein the temperature T in (e) is between a glass transition temperature Tg of the toner particles and Tg+25° C., and wherein the toner has a cross-sectional void fraction Sp/St of 0.1% to 15.0%, where St is a cross-sectional area of the toner particles, and Sp is a cross-sectional area of the voids.

14. An image forming method, comprising:

forming an electrostatic latent image;

developing;

transferring; and fixing, wherein an electrostatic latent image formed on an electrostatic latent image bearing member is developed using a toner obtained by a method comprising:

(a) dissolving or dispersing a toner material comprising a binder resin, a precursor of a binder resin, or both, in an organic solvent;

(b) dispersing a solution obtained in (a) in a first aqueous medium comprising a dispersant;

(c) forming particles by removing the organic solvent from a solution obtained in (b);

(d) washing the particles obtained in (c);

(e) forming voids in the particles obtained in (d) by heating the particles to a temperature T while or after dispersing the particles in a second aqueous medium;

(f) forming toner base particles by adding a charge controlling agent to a solution obtained in (e); and (g) adding an external additive to the toner base particles to obtain toner particles, wherein the temperature T in (e) is between a glass transition temperature Tg of the toner particles and Tg+25° C., and wherein the toner has a cross-sectional void fraction Sp/St of 0.1% to 15.0%, where St is a cross-sectional area of the toner particles, and Sp is a cross-sectional area of the voids.

* * * * *